US008870511B2

(12) United States Patent
Coombe

(10) Patent No.: US 8,870,511 B2
(45) Date of Patent: Oct. 28, 2014

(54) BOOK BINDING APPARATUS

(76) Inventor: Ron Coombe, Sydney (AU)

( * ) Notice: Subject to any disclaimer, the term of this patent is extended or adjusted under 35 U.S.C. 154(b) by 107 days.

(21) Appl. No.: 13/390,326

(22) PCT Filed: Aug. 11, 2010

(86) PCT No.: PCT/AU2010/001030
§ 371 (c)(1),
(2), (4) Date: May 1, 2012

(87) PCT Pub. No.: WO2011/017762
PCT Pub. Date: Feb. 17, 2011

(65) Prior Publication Data

US 2013/0078055 A1 Mar. 28, 2013

(30) Foreign Application Priority Data

Aug. 11, 2009 (AU) ..... 2009900372

(51) Int. Cl.

| | |
|---|---|
| ***B42C 11/00*** | (2006.01) |
| ***B42C 11/02*** | (2006.01) |
| ***B42C 11/04*** | (2006.01) |
| ***B42C 9/00*** | (2006.01) |
| *B42D 3/00* | (2006.01) |

(52) U.S. Cl.
CPC ..... *B42C 11/04* (2013.01); *B42D 3/002* (2013.01); *B42C 9/0056* (2013.01)
USPC ..... 412/4; 412/5; 412/19; 412/21; 33/623; 33/645

(58) Field of Classification Search
USPC ..... 412/1, 2–5, 17, 19–21; 33/613, 623, 33/645
See application file for complete search history.

(56) References Cited

U.S. PATENT DOCUMENTS

| | | | | | |
|---|---|---|---|---|---|
| 1,114,740 | A | * | 10/1914 | Etheridge | 412/19 |
| 1,274,154 | A | * | 7/1918 | Etheridge | 412/19 |
| 1,460,348 | A | * | 6/1923 | Nelson | 33/501 |
| 2,021,214 | A | * | 11/1935 | Wilson | 412/17 |
| 2,150,104 | A | * | 3/1939 | Reavis | 412/17 |

(Continued)

FOREIGN PATENT DOCUMENTS

| | | | |
|---|---|---|---|
| GB | 192 239 | | 2/1923 |
| JP | 03112687 | * | 5/1991 |
| JP | 07290857 | * | 11/1995 |
| WO | WO 2004/030927 | | 4/2004 |

*Primary Examiner* — Kyle Grabowski
(74) *Attorney, Agent, or Firm* — Alston & Bird LLP

(57) ABSTRACT

The present invention relates to a binding apparatus (10) for facilitating placement of a book block (44) in relation to a cover (16). The cover (16) has front and back panels (28 and 32) for subsequent attachment of the book block (44) to the cover (16). The apparatus (10) includes a first guiding means (46), a second guiding means (56), a first positioning element (54) and a second positioning element (62). The first guiding means (46) is adapted to guide a first edge (58) of the front panel (28). The second guiding means (58) is adapted to guide a second edge (37) of the front panel (28). The first positioning element (54) is movably attached to the first guiding means (46) and is adapted in use to abut at least part of a first peripheral surface (60) of the book block (44). The second positioning element (56) is movably attached to the second guiding means (56) and is adapted in use to abut at least part of a second peripheral surface (64) of the book block (44).

24 Claims, 5 Drawing Sheets

(56) References Cited

U.S. PATENT DOCUMENTS

| | | | | |
|---|---|---|---|---|
| 2,943,336 | A * | 7/1960 | Neilon | 412/24 |
| 3,825,964 | A * | 7/1974 | Groswith et al. | 412/21 |
| 3,952,356 | A | 4/1976 | Giulie et al. | |
| 5,044,857 | A * | 9/1991 | Crudo | 412/19 |
| 7,134,822 | B2 * | 11/2006 | Parker et al. | 412/19 |
| 2004/0067123 | A1 * | 4/2004 | Parker et al. | 412/19 |

* cited by examiner

BOOK BINDING APPARATUS

TECHNICAL FIELD

This invention relates to a binding apparatus suitable for binding printed matter. The invention relates particularly but not restricted to placement of a book block in relation to a book cover in a book binding process.

BACKGROUND OF THE INVENTION

It is generally problematic to neatly secure a book block in a desired position in relation to a book cover in the process of binding the book block to the book cover. Improper or imperfect disposition of the book block in relation to the cover would severely impact on the overall appearance and hence attractiveness of the book.

It is an object of the present invention to provide a binding apparatus which may overcome or ameliorate the foregoing problem or at least provide a useful alternative.

SUMMARY OF THE INVENTION

Accordingly there is provided a binding apparatus for facilitating placement of a book block in relation to a cover having front and back panels for subsequent attachment of the book block to the cover, the apparatus including:

a first guiding means adapted to guide a first edge of the front panel;

a second guiding means adapted to guide a second edge of the front panel;

a first positioning element movably attached to the first guiding means and adapted in use to abut at least part of a first peripheral surface of the book block; and a second positioning element movably attached to the second guiding means and adapted in use to abut at least part of a second peripheral surface of the book block.

It should be noted that the book block may include a pile of loose leaves bound between front and back fly sheets. The loose leaves may include heavy paper such as gloss paper.

Preferably, the first and second guiding means in combination secure the book cover in a predetermined position. More preferably, the first and second guiding means are substantially perpendicular to each other.

Preferably, the apparatus includes a grid having first, second and third bars. The bars are preferred to be spaced apart and parallel to one another. The bars may be configured and arranged such that the first bar provides support for the first edge of the front panel, the second bar for at least part of a spine panel, and the third bar for a first edge of the back panel, respectively.

The grid is also preferred to include first and second rails which movably interlock with and run substantially perpendicular to the bars. The rails are preferred to be spaced apart to support the second edge of the front panel and an opposing edge, respectively. In this embodiment, the rails also support a second edge and another opposing edge of the back panel, respectively. The second rail may be designed so that it is slidable along the length of the bars to suit covers of different dimensions.

It should be understood that the cover also preferably includes a spine panel adjoining the front and back panels. When the apparatus is in use, the cover is preferred to be rested on the grid in an unfolded state.

The first guiding means is preferred to include a bracket which is mounted to the first bar. The bracket in this embodiment is L-shaped, having vertical and horizontal members.

The vertical member preferably includes a slot adapted to movably receive the first positioning element.

The second guiding means is preferred to include a wall adapted in use to abut the second edge of the front panel (and back panel). In this embodiment, the wall is disposed in an upright position substantially perpendicular to the base.

At least part of the first positioning element is preferred to be located above the cover resting on the grid. It is preferred that the first positioning element is adjustable to a desired position to provide in use a first margin between the first edge of the front panel and a first peripheral surface of the book block.

In a similar way, at least part of the second positioning element is preferred to be located above the cover resting on the grid. It is preferred that the second positioning element is adjustable to a desired position to in use provide a second margin between the second edge of the front panel and a second peripheral surface of the book block.

Preferably, the apparatus of the present invention also includes a third guiding means adapted to abut the opposing edge of the front panel. In a preferred embodiment, the third guiding means includes a bracket adapted to be movably mounted on the first and second bars. The third guiding means may be locked to the bars by fixing means. The fixing means may include a biasing means adapted to facilitate gliding of the third guiding means on the bars. The fixing means may include one or more screws with a spring loaded device.

Conveniently, the third guiding means includes a bevel adapted in use to direct the block of bound paper towards the second positioning element thereby achieving placement of the block in the desired position with respect to the cover.

It is intended that, once the book block is placed in the desired position, a front fly sheet of the book block may be attached to a predetermined part of the spine panel of the cover resting on the structure via an adhesive member. The back panel may then be folded over onto a back fly sheet of the book block so as to bond another predetermined part of the spine panel to the back fly sheet.

The height of the vertical member of the first guiding means is preferred to be higher than the thickness of the book block. When the back panel is folded onto the book block, a first edge of the back panel may abut the first guiding means, thereby achieving alignment of the first edge of the back panel with the first edge of the front panel.

Similarly, the height of the wall of the second guiding means is preferred to be higher than the thickness of the book block. When the back panel is folded onto the book block, a second edge of the back panel may abut the second guiding means, thereby achieving alignment of the second edge of the back panel with the second edge of the front panel.

Preferably, the spine panel has another adhesive member adapted to bond the back panel to the back fly sheet when the back panel is folded onto and pressed against the back fly sheet.

BRIEF DESCRIPTION OF THE DRAWINGS

The invention may be better understood from the following non-limiting description of a preferred embodiment, in which.

DETAILED DESCRIPTION OF THE DRAWINGS

Figure 1:
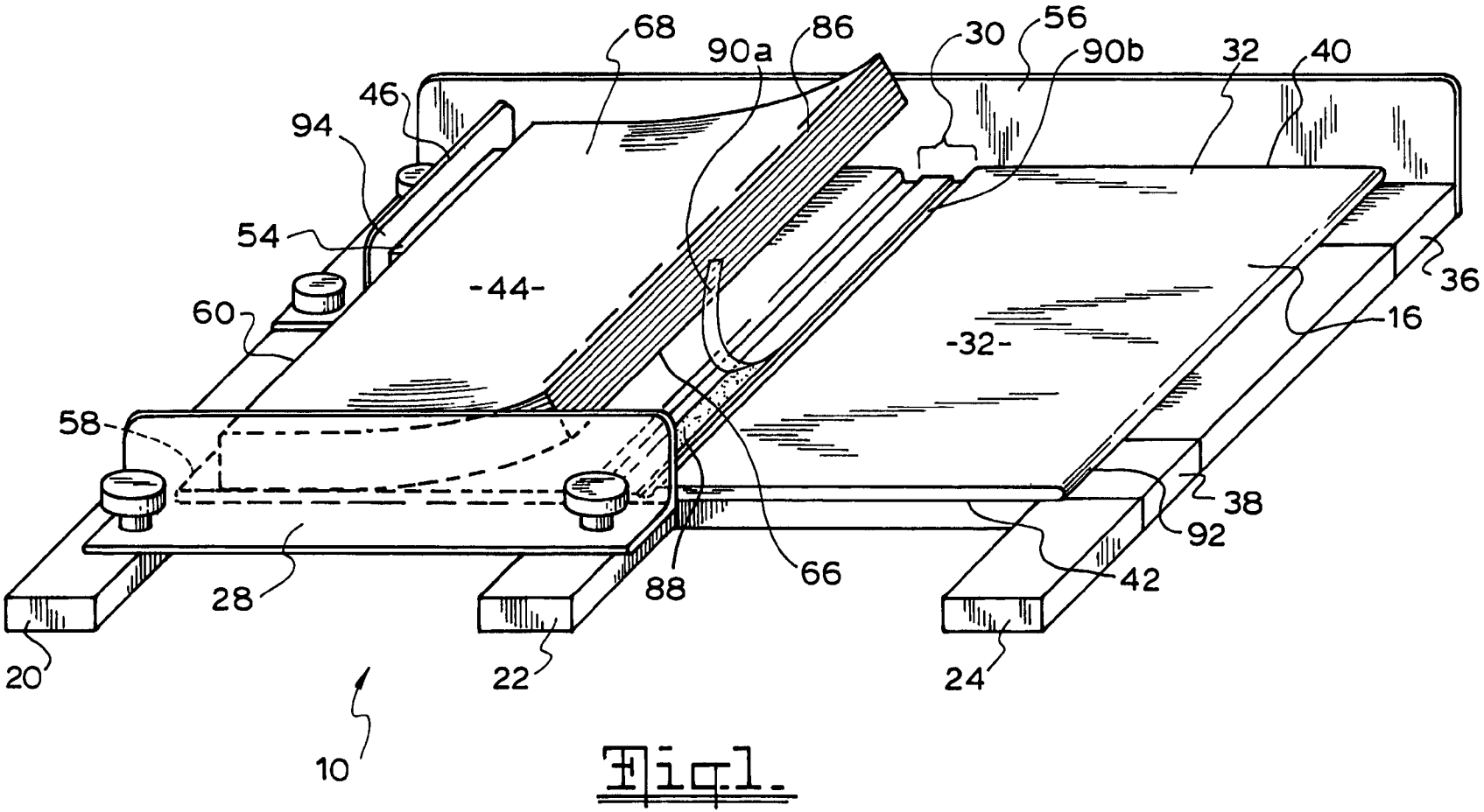
FIG.1 is a perspective view of a binding apparatus in accordance with the preferred embodiment of the present invention supporting a book cover disposed in an unfolded state.

Referring to FIG.1, a binding apparatus 10 supports an unfolded book cover 16 having a front panel 28, a spine panel 30 and a back panel 32. The book cover 16 is to be bonded to a book block 44 which comprises a pile of loose leaves intermediate front and back fly sheets 66 and 68. The loose leaves and the fly sheets 66 and 68 are bound by steel stitches or staples. The loose leaves in the present embodiment include gloss paper for photos.

The apparatus 10 has a grid with first, second and third bars 20, 22 and 24 which are spaced apart and parallel to one another. The first bar 20 provides support for a lateral edge 58 of the front panel 28. The second bar 22 is located intermediate the first and third bars 20 and 24 to provide support for the spine panel 30. The third bar 24 supports a lateral edge 92 of the back panel 32.

Figure 4:
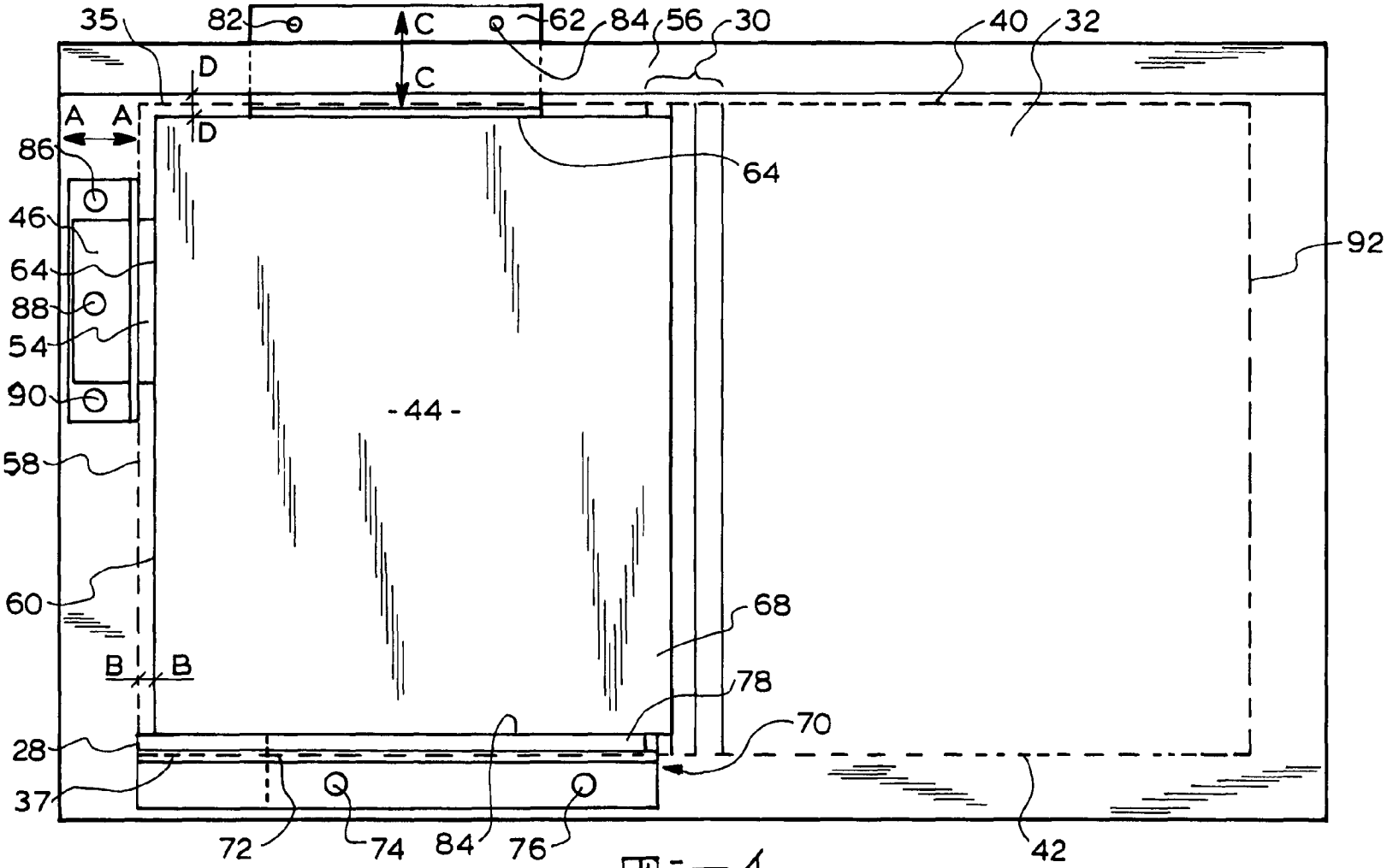
FIG.4 is a plan view of the binding apparatus of FIG.1.

The grid also includes first and second transverse rails 36 and 38 which movably interlock with and run substantially perpendicular to each of the bars 20, 22 and 24. The rails 36 and 38 are spaced apart to support top and bottom edges 35 and 37 (see FIG.4) of the front panel 28 as well as top and bottom edges 40 and 42 (see FIG.4) of the back panel 32. The rail 38 is slidable along the length of the bars 20, 22 and 24 to suit covers of different dimensions. As best shown in FIG.4, the panels 28, 30 and 32 are supported by the grid and ready for placement of the book block 44 thereon.

Figure 2:
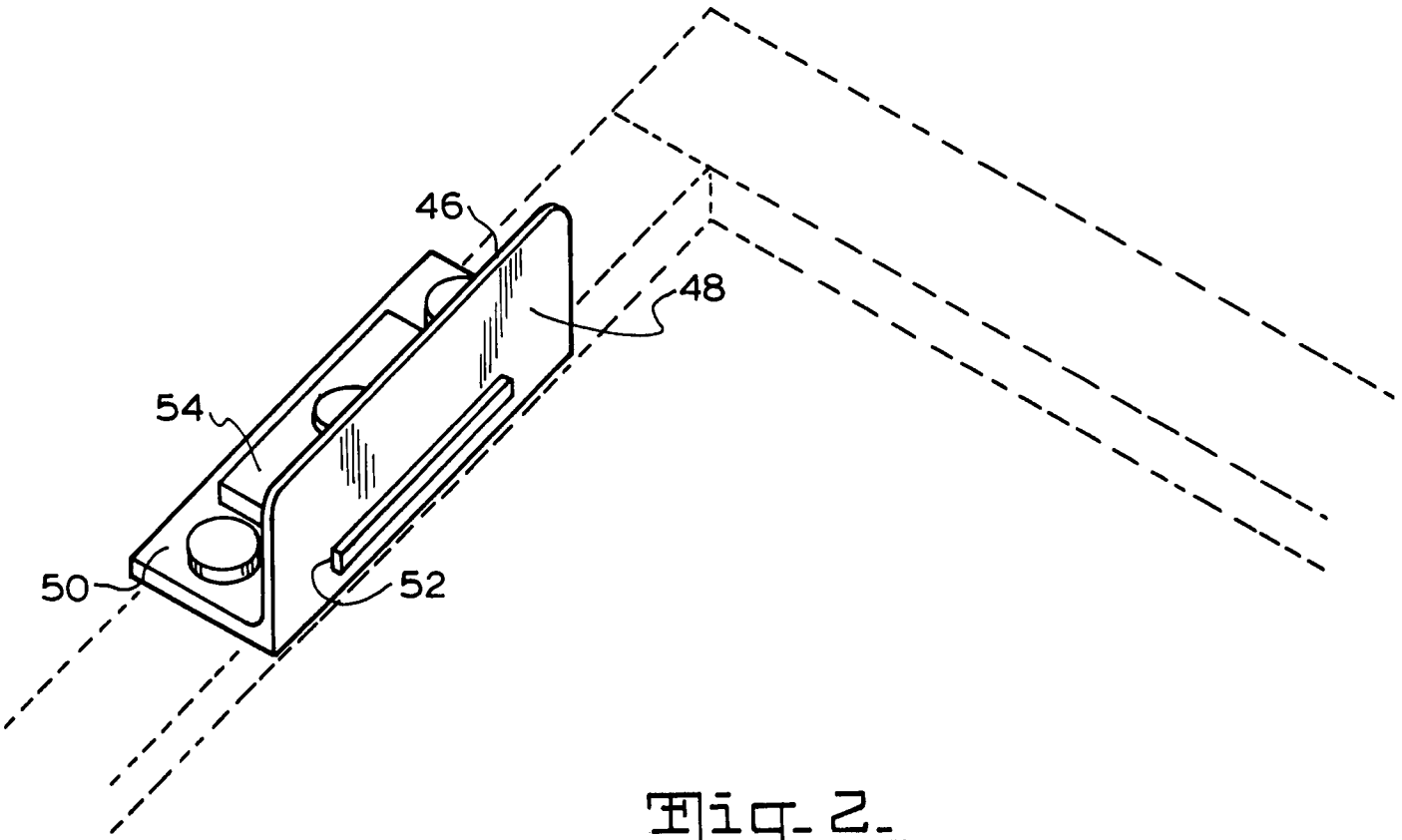
FIG.2 is a perspective view from the front of first guiding and positioning element of the binding apparatus of FIG.1.
Figure 3:
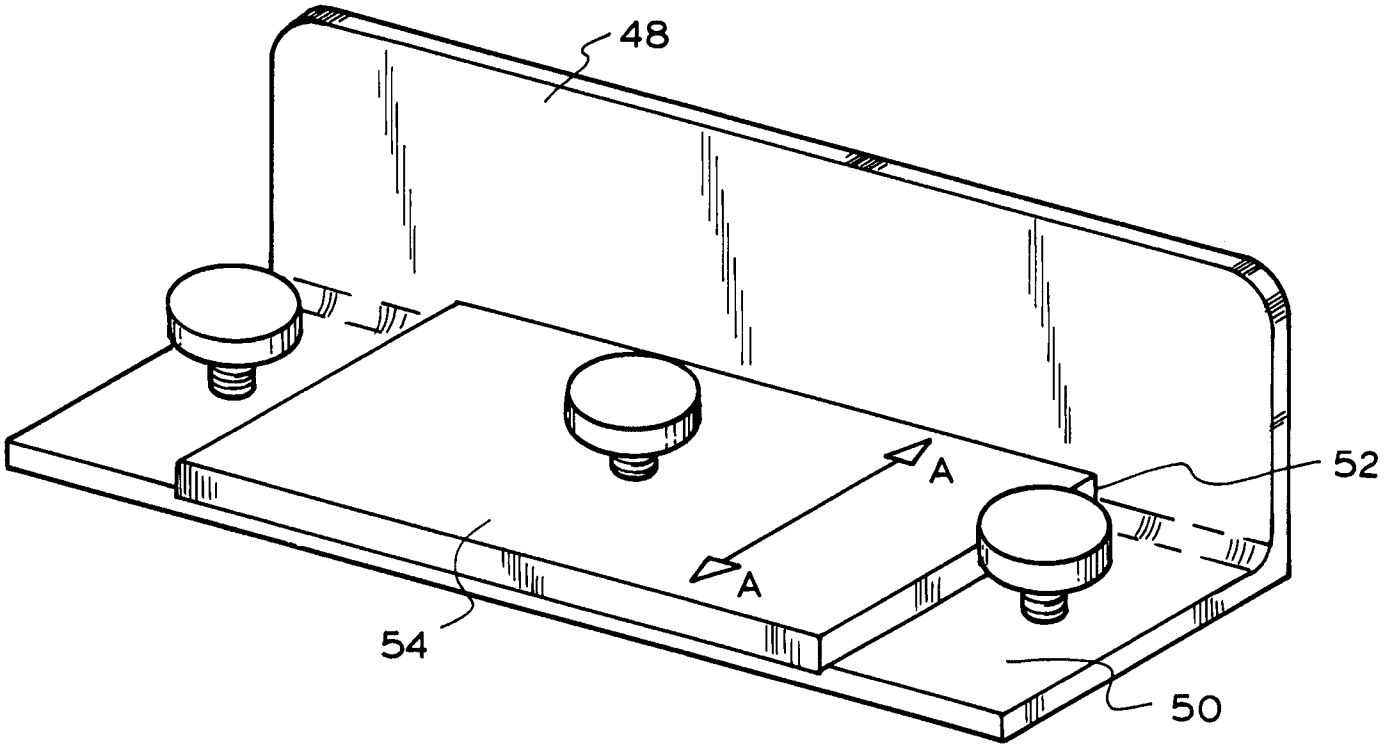
FIG.3 is a perspective view from the back of the first guiding and positioning element of FIG.2.

The binding apparatus 10 has a guiding means which is movably connected to the bar 20. Turning to FIGS. 2 and 3, the guiding means is in the form of a bracket 46 which is mounted to the bar 20 and in use guides the lateral edge 58 of the front panel 28 (refer FIG.1). The bracket 46 is L-shaped having vertical and horizontal members 48 and 50, respectively. The vertical member 48 includes a slot 52 which receives a movable positioning element in the form of a plate 54.

As shown in FIGS. 1 and 4, the binding apparatus 10 also has another guiding means in the form of a wall 56 which in use guides and abuts the top edges 35 and 40 of the front and back panels 28 and 32. The wall 55 is disposed in an upright position substantially perpendicular to the grid.

Referring to FIG.4, the plate 54 in use abuts part of a peripheral surface 60 of the book block 44. In a similar way, positioning element in the form of a plate 62 is movably attached to the wall 56 and abuts part of a second peripheral surface 64 of the book block 44.

As best shown in FIG.1, the plate 54 is located above the cover 16 resting on the base. Referring to FIGS. 3 and 4, the plate 54 is adjustable to move forward and backward as indicated by the arrows A-A in FIGS. 3 and 4 to a desired position to provide in use a margin B-B between the lateral edge 58 (see FIG.4) of the front panel and the first peripheral surface 60 of the book block 44.

Similarly, the plate 62 is located above the cover 16 which rests on the base. The plate 62 is adjustable to move forward and backward as indicated by arrows C-C (see FIG.4) to a desired position to provide in use a margin D-D between the top edge 35 of the front panel and the second peripheral surface 64 of the book block 44. The plates 54 and 62 are substantially perpendicular to each other.

Referring to FIG.4, the binding apparatus 10 also includes a further guiding means which takes the form of an L-shaped bracket 70. The bracket 70 in use abuts a bottom edge 72 of the front panel 28. The bracket 70 is movably mounted on the bars 20 and 22. Once moved to a desired location, the bracket 70 can be locked in place by fixing means such as screws 74 and 76. Each of the screws 74 and 76 includes an enlarged head portion to facilitate gripping by a user. The bracket 70 assists in securing the book block 44 in the desired position for bonding of the book block 44 to the book cover 16.

The bracket 70 includes a bevel 78 with a slanted surface. The bevel 78 is convenient to placement of the book block 44 in that it directs the book block 44 of bound paper towards the plate 62.

The application of the binding apparatus 10 will now be described. The first step is to place the book cover 16 on the base. The cover 16 is to be rested on the base in an unfolded state. The cover 16 is then pushed against the bracket 46 and wall 56 such that the edges 58 and 35 of the front panel 28 abut the bracket 46 and wall 56, respectively.

Once the book cover 16 is put in place, the bracket 70 is brought into contact with the edge 72 of the front panel 28. This further secures the cover 16 in position.

The plates 54 and 62 are then adjusted to the desired positions, respectively. To achieve this, screws 82, 84, 86, 88 and 90, each of which has an enlarged head portion, are loosened to allow the respective plates 54 and 62 to slide forward or backward to a desired position. The positions of the respective plates 54 and 62 are dictated by the desired margins B-B and D-D. The plates 54 and 62 in combination secure the book block 44 in the desired position in relation to the front and back panels 28 and 32.

Once the plates 54 and 62 are fixed in position, the book block 44 may be put onto the front panel 28 of the cover 16. The block 44 should be positioned in such a way that the bottom edge 84 of the book block 44 is aligned with the bevel 78. As such, the book block 44 is directed towards the wall 56 resulting in the peripheral surface 64 of the block 44 abutting the plate 62. Simultaneously, the book block 44 is pushed laterally towards the bracket 46 such that the peripheral surface 60 abuts the plate 54.

Referring to FIG.1, the above steps should be carried out with dexterity so as to avoid premature engagement of the front fly sheet 66 near a rear end 86 of the book block 44 with an adhesive member 88 provided on the spine panel 30. The adhesive member 88 is preserved by a tape 90*a* which is to be peeled off exposing the adhesive when the block 44 is in position for engagement with the cover 16.

Figure 5:
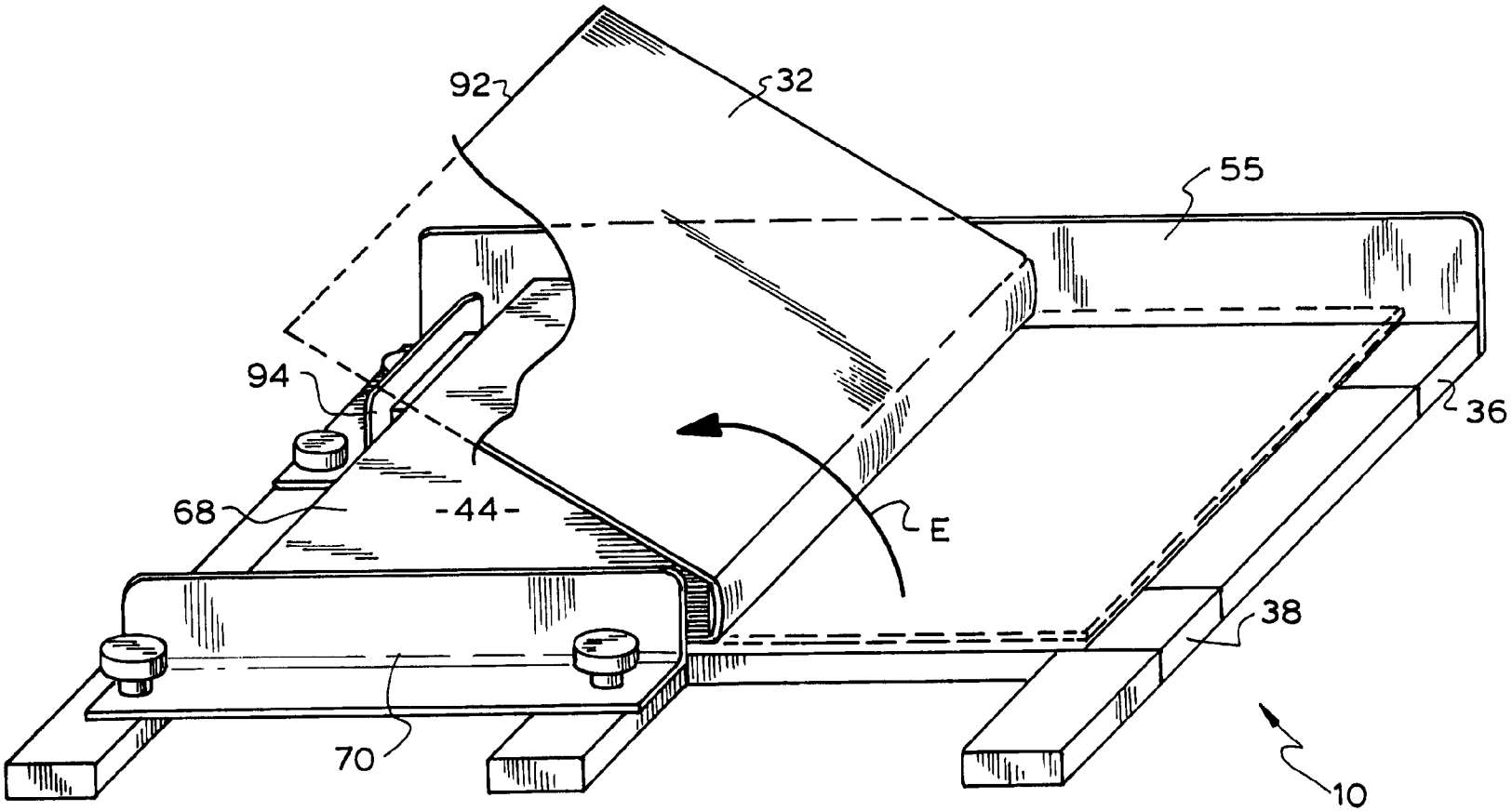
FIG.5 is a perspective view of the binding apparatus of FIG.1 illustrating the book cover being folded.

Turning now to FIG.5, to complete the binding process, the back panel 32 is folded onto the back fly sheet 68 so as to effect bonding of another adhesive member 90*b* (refer FIG.1) provided on the spine panel 30 to the back fly sheet 68. To facilitate alignment of the front panel 28 with the back panel 32, the lateral edge 92 of the back panel 32 is brought into contact with the upper portion 94 of the bracket 46.

It should be noted from FIG.2 combined with FIG.1 that the height of the vertical member 48 of the bracket 46 is higher than the thickness of the book block 44. When the back panel 32 is folded onto the book block 44, the lateral edge 92 of the back panel 32 can be pushed laterally to abut the upper portion 94 (see FIGS. 1 and 5) of the bracket 46 thereby achieving accurate alignment of the back panel 32 with the front panel 28.

Similarly, the height of the wall 56 is higher than the thickness of the book block 44. When the back panel 32 is folded onto the book block 44, the top edge 40 of the back panel 32 abuts the wall 56.

Now that a preferred embodiment of the present invention has been described in some detail, it will be apparent to those skilled in the art that the binding apparatus may offer at least the following advantages:

1. It is simple and easy to use, requiring a minimum degree of skill, dexterity and time;
2. It can facilitate swift attachment of a book block to a cover with a high degree of precision; and
3. It can produce a permanently bound book.

Those skilled in the art will appreciate that the invention described herein is susceptible to variations and modifications other than those specifically described. All such variations and modifications are to be considered within the scope and spirit of the present invention the nature of which is to be determined from the foregoing description.

INDUSTRIAL APPLICABILITY

The binding apparatus of the present invention is industrially applicable in that it facilitates swift attachment of a book block to a cover with a high degree of precision for the production a permanently bound book.

The invention claimed is:

1. A binding apparatus for facilitating placement of a book block in relation to a cover having front and back panels for subsequent attachment of the book block to the cover, the apparatus including:

a first guiding means adapted to guide a first edge of the front panel;

a second guiding means adapted to guide a second edge of the front panel;

a first positioning element movably attached to the first guiding means and adapted in use to abut at least part of a first peripheral surface of the book block; and a second positioning element movably attached to the second guiding means and adapted in use to abut at least part of a second peripheral surface of the book block, wherein:

the apparatus includes a grid having first, second and third bars; and the grid includes first and second rails which movably interlock with and run substantially perpendicular to the bars.

2. The binding apparatus of claim 1, wherein the first and second guiding means are adapted to combine to secure the book cover in a predetermined position.

3. The binding apparatus of claim 1, wherein the first and second guiding means are substantially perpendicular to each other.

4. The binding apparatus of claim 1, wherein the bars are spaced apart and parallel to one another.

5. The binding apparatus of claim 1, wherein the bars are configured and arranged such that the first bar provides support for the first edge of the front panel, the second bar for at least part of a spine panel, and the third bar for a first edge of the back panel, respectively.

6. The binding apparatus of claim 1, wherein the rails are spaced apart to support the second edge of the front panel and an opposing edge, respectively.

7. The binding apparatus of claim 6, wherein the second guiding means includes a wall adapted in use to abut the second edge of the front panel.

8. The binding apparatus of claim 7, wherein the wall is disposed in an upright position substantially perpendicular to the base.

9. The binding apparatus of claim 6, which includes a third guiding means adapted to abut the opposing edge of the front panel.

10. The binding apparatus of claim 9, wherein the third guiding means includes a bracket adapted to be movably mounted on the first and second bars.

11. The binding apparatus of claim 9, wherein the third guiding means is locked to the bars by a fixing means.

12. The binding apparatus of claim 11, wherein the fixing means includes a biasing means adapted to facilitate gliding of the third guiding means on the bars.

13. The binding apparatus of claim 11, wherein the fixing means include one or more screws with a spring loaded device.

14. The binding apparatus of claim 9, wherein the third guiding means includes a bevel adapted in use to direct the block of bound paper towards the second positioning element thereby achieving placement of the block in the desired position with respect to the cover.

15. The binding apparatus of claim 1, wherein the rails also support a second edge of the back panel and another opposing edge, respectively.

16. The binding apparatus of claim 1, wherein the second rail is designed so that it is slidable along the length of the bars to suit covers of different dimensions.

17. The binding apparatus of claim 1, wherein the first guiding means includes a bracket which is mounted to the first bar.

18. The binding apparatus of claim 17, wherein the bracket is L-shaped, having vertical and horizontal members.

19. The binding apparatus of claim 18, wherein the vertical member includes a slot adapted to movably receive the first positioning element.

20. The binding apparatus of claim 1, wherein at least part of the first positioning element is located above the cover resting on the grid.

21. The binding apparatus of claim 1 wherein the first positioning element is adjustable to a desired position to provide in use a first margin between the first edge of the front panel and a first peripheral surface of the book block.

22. The binding apparatus of claim 1, wherein at least part of the second positioning element is located above the cover resting on the grid.

23. The binding apparatus of claim 1, wherein the second positioning element is adjustable to a desired position to in use provide a second margin between the second edge of the front panel and a second peripheral surface of the book block.

24. The binding apparatus of claim 1, further comprising an adhesive member adapted in use to attach a front fly sheet of the book block to a predetermined part of the spine panel of the cover resting on the structure.

* * * * *